US005458962A

United States Patent [19]

Birch

[11] Patent Number: 5,458,962

[45] Date of Patent: Oct. 17, 1995

[54] NONWOVEN SURFACE TREATING ARTICLES AND METHODS OF MAKING AND USING SAME

[75] Inventor: D'Arcie W. Birch, Oakdale, Minn.

[73] Assignee: Minnesota Mining and Manufacturing Company, St. Paul, Minn.

[21] Appl. No.: 180,855

[22] Filed: Jan. 13, 1994

Related U.S. Application Data

[63] Continuation-in-part of Ser. No. 105,363, Aug. 11, 1993, abandoned.

[51] Int. Cl.[6] ..... D04H 1/58

[52] U.S. Cl. ..... 428/288; 15/209.1; 428/283; 428/290; 428/360; 428/361

[58] Field of Search ..... 428/283, 288, 428/290, 360, 361; 15/209.1

[56] References Cited

U.S. PATENT DOCUMENTS

| | | | |
|---|---|---|---|
| 2,958,593 | 11/1960 | Hoover et al. | 51/295 |
| 3,537,121 | 11/1970 | McAvoy | 15/203.12 |
| 4,893,439 | 1/1990 | McAvoy et al. | 51/400 |
| 5,030,496 | 7/1991 | McGurran | 428/85 |
| 5,178,646 | 1/1993 | Barber, Jr. et al. | 51/298 |

FOREIGN PATENT DOCUMENTS

| | | |
|---|---|---|
| 0021680 | 6/1980 | European Pat. Off. . |
| 0397374A2 | 5/1990 | European Pat. Off. . |
| 0552762A2 | 1/1993 | European Pat. Off. . |
| 131826 | 7/1978 | Germany . |
| WO94/04738 | 3/1994 | WIPO . |

OTHER PUBLICATIONS

"Rhoplex" ST–954, Rohm & Haas, (Apr.1992).

"Elvanol" Product and Properties Guide, duPont, (publication date unknown but prior to Jul. 29, 1993).

duPont Material Safety Data Sheet for "Elvanol" Polyvinyl Alcohol, Mar. 30, 1993.

*Primary Examiner*—James J. Bell

*Attorney, Agent, or Firm*—Gary L. Griswold; Walter N. Kirn; Daniel R. Pastirik

[57] ABSTRACT

A nonwoven surface treating article suitable for treating surfaces while emitting little formaldehyde includes an open, lofty, three-dimensional nonwoven web of a plurality of thermoplastic organic fibers a bound together at places where they contact by a binder, binder comprising 1) a copolymer of an acrylate monomer and an acrylamide monomer, 2) the crosslinked reaction product of a polyol and a melamine crosslinking agent, and 3) the reaction product of a urea derivative and formaldehyde.

17 Claims, No Drawings

NONWOVEN SURFACE TREATING ARTICLES AND METHODS OF MAKING AND USING SAME

CROSS REFERENCE TO RELATED APPLICATIONS

This application is a continuation-in-part of assignee's application abandoned Ser. No. 08/105,363, filed Aug. 11, 1993 abandoned.

BACKGROUND OF THE INVENTION

1. Field of the Invention

This invention relates to nonwoven surface treating articles which are useful for surface treatment, particularly polishing of various surfaces.

2. Related Art

The appearance of a surface may be indicated by "shininess", or "gloss". The "gloss" produced by buffing a surface with a surface treating article attached to a conventional rotary floor machine depends on a number of factors. Among these are the type of abrasive article employed, the nature and amount of ancillary chemical used (if any) with the article, the pressure applied to the floor, the speed of rotation of the article, the treatment time at given pressure, etc. To ensure acceptable gloss production as a result of the treatment procedure, the user tries to optimize all of these parameters. The goal is a high gloss, high durability, stain resistant floor, achieved with a minimum of labor.

Uniform, lofty, open, nonwoven three-dimensional abrasive articles are known for use in cleaning and polishing floors and other surfaces. Examples of such nonwoven surface treating articles are the nonwoven abrasive pads made according to the teachings of Hoover, et al., U.S. Pat. No. 2,958,593; McAvoy, U.S. Pat. No. 3,537,121; McAvoy, et al., U.S. Pat. No. 4,893,439; and McGurran, U.S. Pat. No. 5,030,496. Hoover et al. describe such nonwoven pads as comprising:

> many interlaced randomly disposed flexible durable tough organic fibers which exhibit substantial resiliency and strength upon prolonged subjection to water and oils. Fibers of the web are firmly bonded together at points where they intersect and contact one another by globules of an organic binder, thereby forming a three-dimensionally integrated structure. Distributed within the web and firmly adhered by binder globules at variously spaced points along the fibers are abrasive particles.

Hoover, et al., at column 2, lines 61–70, column 3, line 1.

U.S. Pat. No. 5,030,496 (McGurran) describes nonwoven fibrous surface treating articles formed of entangled synthetic fibers bonded together at points where they contact one another by a binder resin comprising plasticized vinyl resin (e.g., polyvinyl chloride or "PVC") and a condensation polymerized amine-formaldehyde derivative (e.g., melamine).

Nonwoven abrasive pads such as disclosed by McGurran, while finding wide ranging use, are disadvantageous from a production standpoint since the condensation polymerization reaction of the melamine during curing may generate volatile organic hydrocarbons (VOC). Various formaldehyde "scavengers", such as phenol, urea, dicyanodiamide, and beta-ketobutyramide, are known but each has its faults. Use of phenol is discouraged because it is a VOC. Dicyanodiamide and beta-ketobutyramide are incompatible with the melamine/PVC system because the system is organic in nature, and dicyanodiamide and beta-ketobutyramide are insoluble in the organic solvents frequently employed in production facilities used to dissolve or disperse the melamine/PVC. Urea is also insoluble in the organic solvents employed in production facilities, but can be incorporated into the melamine/PVC system in dry form; however, the resulting melamine/PVC/urea mixtures may be unstable. During the time period required for coating fibrous webs, phase separation of the urea from the melamine/PVC may occur, which may not be eliminated by decreasing the urea particle size.

Urea, however, is much more soluble in aqueous solutions than either dicyanodiamide and beta-ketobutyramide, thus requiring less energy to remove water during coating, drying, and/or coating procedures. The Merck Index, page 1553, (1989) discloses that one gram of urea will be dissolved in only one milliliter of water at room temperature, whereas one gram of dicyanodiamide requires 3 milliliters of water, and beta-ketobutyramide requires 15 milliliters of water.

Thus, it would be advantageous if binder precursor compositions could be developed for use in forming nonwoven abrasive articles having the performance characteristics described by McGurran, while avoiding the generation of VOCs and reducing energy consumption.

SUMMARY OF THE INVENTION

In accordance with the present invention, surface treating articles are presented which address some of the above-noted concerns and which are useful in increasing gloss of vinyl, marble, wood, concrete, and the like.

This invention provides a flexible and resilient, fibrous surface treating article comprising an open, lofty, nonwoven fibrous web formed of entangled, (preferably synthetic, organic fibers, such as polyester staple fibers) bonded together at points where they contact one another by an inventive binder. As used herein the term "binder" means a cured binder, whereas the term "binder precursor" means a coatable composition which includes a binder resin which, when exposed to curing conditions, becomes a binder.

One embodiment of the inventive binder comprises 1) a copolymer of an acrylate monomer and an acrylamide monomer, 2) a crosslinked reaction product of a polyol and a melamine crosslinking agent, and 3) a reaction product of a urea derivative and formaldehyde. If the acrylamide monomer and melamine crosslinking agents have pendant alkylol groups (i.e., —$RCH_2OH$ groups), it is within the scope of the invention that the urea derivative reacts also with the alkylol groups of the copolymer and/or the crosslinking agent.

Formaldehyde is generated during curing from both the portion of the copolymer derived from acrylamide monomer, which has pendant —C(O)NR'R' groups, and the melamine crosslinking agent, which decomposes upon heating.

The urea derivative (preferably urea) has at least one functional group which is reactive with aldehydes, and preferably another functional group independently reactive with groups selected from the group consisting of aldehydes and alkylol groups. The urea derivative also preferably has a solubility in water at room temperature (about 25° C.) greater than 1 gram per three milliliters of water. If two or more compounds are employed as the urea derivative, the solubility of the combination of compounds has the stated solubility.

Another aspect of the invention is an aqueous, coatable, thermally condensable composition comprising:

(a) an aqueous dispersible copolymer of an acrylate monomer and an acrylamide monomer;

(b) an at least partially hydrolyzed polymer having a plurality of pendant hydroxy groups, the pendant hydroxy groups derived from a plurality of hydrolyzable pendant groups (preferably polyvinyl acetate);

(c) a melamine crosslinking agent; and (d) a urea derivative.

Preferred aqueous, coatable compositions are those wherein the urea derivative is urea, and those compositions which include a rheology modifying filler having a Mohs hardness equal to or less than calcium carbonate, such as calcium carbonate or amorphous silica.

Another aspect of the invention is a second flexible and resilient, fibrous surface treating article as described in the first embodiment, except that the binder comprises 1) a copolymer of a styrenic monomer (preferably styrene) and a diene monomer (preferably butadiene), 2) a polyol, 3) an optional melamine crosslinking agent, and 4) an optional reaction product of a urea derivative and formaldehyde. It is within the scope of the invention that the urea derivative, if present, reacts with the hydroxyl groups of the polyol and with any formaldehyde originating from the optional melamine curing agent. Preferably, a melamine crosslinking agent is employed but at weight percentages low enough to avoid the use of a urea derivative for scavenging formaldehyde; any formaldehyde generated may then react with the hydroxyl groups of the polyol component.

Another aspect of the invention is a second embodiment of an aqueous, coatable, thermally condensable composition comprising:

(a) an aqueous dispersible copolymer of a styrenic monomer and a diene monomer;

(b) an at least partially hydrolyzed polymer having a plurality of pendant hydroxy groups, the pendant hydroxy groups derived from a plurality of hydrolyzable pendant groups (preferably polyvinyl acetate);

(c) an optional melamine crosslinking agent; and (d) an optional urea derivative.

A further aspect of the invention is a method of increasing the gloss of hard surfaces. "Gloss" is determined in accordance with a standard test as described in the Test Methods section. The method comprises contacting a nonwoven surface treating article within the invention with the surface while causing relative movement between the surface and the article, thereby producing a high gloss surface.

Further aspects and advantages of the invention will become apparent from the description which follows.

DESCRIPTION OF PREFERRED EMBODIMENTS

Binder Precursor Compositions

A. Urea Derivatives

The urea derivative has as its primary function the ability to react with aldehydes, particularly formaldehyde, generated during the thermal curing operations of the inventive binder precursor compositions. In the second article embodiment, where it is preferred that a melamine crosslinking agent is employed but at weight percentages low enough to avoid the use of a urea derivative for scavenging formaldehyde, any formaldehyde generated may react with the hydroxyl groups of the polyol component.

The urea derivative may also participate in reactions with other binder precursors in dynamic equilibrium, functioning as a crosslinking agent between individual aqueous dispersible copolymer chains, between individual polyol chains, and/or between aqueous dispersible copolymer chains and polyol chains.

A third function of the urea derivative is to react, also in dynamic equilibrium reactions, with nonreacted optional resin precursors, such as phenol and phenolic derivatives, such as resorcinol, m-cresol, 3,5-xylenol, t-butyl phenol, p-phenylphenol and the like, and optional aldehydes such as additional formaldehyde (i.e. not generated form other binder precursors), acetaldehyde, chloral, butylaldehyde, furfural, and acrolein.

Urea is one particularly preferred urea derivative because of its good water solubility and availability. Other particularly preferred urea derivatives are those compounds selected from the group consisting of:

A) compounds selected from the group consisting of compounds represented by the general formula (I)

$$R^1-\overset{\overset{R^2}{\|}}{N}-\overset{\overset{X}{\|}}{C}-Y \qquad (I)$$

and mixtures thereof wherein X=O or S and Y=—$NR^3R^4$ or —$OR^5$, such that when X=S, Y=$NR^3R^4$, each of $R^1$,$R^2$, $R^3$, $R^4$ and $R^5$ is a monovalent radical selected from the group consisting of hydrogen, alkyl groups having 1 to about 10 carbon atoms, hydroxyalkyl groups having from about 2 to 4 carbon atoms and one or more hydroxyl groups, and hydroxypolyalkyleneoxy groups having one or more hydroxyl groups, and with the provisos that:

(i) said compound contains at least one —NH and one —OH group or at least two —OH groups or at least two —NH groups;

(ii) $R^1$ and $R^2$ or $R^1$ and $R^3$ can be linked to form a ring structure; and (iii) $R^1$, $R^2$, $R^3$, $R^4$ and $R^5$ are never all hydrogen at the same time;

B) compounds having molecular weight less than about 300 and selected from the group consisting of alkyl substituted 2-aminoalcohols, β-ketoalkylamides, and nitro alkanes;

C) poly(oxyalkylene) amines having molecular weight ranging from about 90 to about 1000; and D) poly(oxyalkylene) ureido compounds having molecular weight ranging from about 90 to about 1000, and combinations of any two or more of these.

Particularly preferred urea derivatives within general formula (I) include hydroxyethyl ethylene urea, or "HEEU" wherein X is O, Y=$NR^3R^4$, $R^1$ is 2-hydroxyethyl, $R^2$ and $R^3$ are linked to form an ethylene bridge, and $R^4$ is hydrogen, and others listed in U.S. Pat. No. 5,039,759, columns 9–13, which are incorporated herein by reference.

A preferred alkyl substituted 2-aminoalcohol useful in the invention is 2-amino-2-methyl-1-propanol. While some β-ketoalkylamides, such as β-ketobutyramide, are substantially lower in solubility than urea, it is within the scope of the invention to employ combinations of highly water soluble compounds (for example urea) with a compound having a low water solubility (such as β-ketobutyramide).

Additionally, nitroalkanes with at least 1 active hydrogen atom attached to the alpha carbon atom will react with aldehydes in the aqueous, coatable thermally condensable binder precursor compositions of this invention.

Representative useful poly(oxyalkylene) amines include poly(oxyethylene-co-oxypropylene) amine, poly(oxypropylene) amine, and poly(oxypropylene) diamine, whereas representative poly(oxyalkylene) ureido compounds are the reaction product of urea and the poly(oxyalkylene) amines previously enumerated. These compounds are readily available from Texaco Chemical Company, Houston, Tex., under the trade designation "Jeffamine".

B. Aqueous Dispersible Copolymer

The primary function of the aqueous dispersible copolymer is to bind the fibers of the nonwoven article at points where they contact to form a nonwoven article which will not substantially disintegrate during use to buff, polish, or improve the gloss of a surface. The aqueous dispersible copolymer serves this function by supplying supple polymeric chains which form "soft" regions in the binder.

Aqueous dispersible copolymers useful in the inventive coatable compositions may be anionic, cationic, or neutral charged.

The aqueous dispersible copolymers useful in formulating the binder precursor compositions of the first preferred type comprise polymerized units of acrylate monomers and acrylamide monomers. The aqueous dispersible copolymers useful in formulating the binder precursor compositions of the second preferred type comprise polymerized units of styrenic monomers and diene monomers. In either case, the copolymer may include other functionalized or nonfunctionalized monomer units in the polymer backbone, such as chain extenders, and the like. Thus the term "copolymer" is not to be strictly construed as limited to polymers composed only of two specific different monomers, but includes polymers comprised of more than two different monomer units, and not all monomer units need be "acrylates" or "acrylamides" in the first embodiment or all "styrenic" or "diene" in the second embodiment.

The distribution of acrylate and acrylamide monomers (or styrenic and diene monomers, as the case may be) within each copolymer chain is not critical, random or block copolymers being acceptable. The relative proportions of the acrylate and acrylamide monomer units in the dispersion of the first embodiment is somewhat more critical in that at least a portion of the copolymer chains must have at least one acrylamide unit so that at least one pendant —C(O)—NR'R" is available for generating an aldehyde molecule.

From this it should be apparent to those skilled in the art that the term "acrylamide" as used herein is not limited to the case where R' and R" are hydrogen. R' and R" may be independently selected from the group consisting of H (i.e. hydrogen) and $C_1$–$C_{12}$ (inclusive) normal, branched or cyclic alkyl, wherein the alkyl group(s) may be substituted with moieties such as halogen, amino, alkylol, and the like. Preferably R' and R" are hydrogen due to current availability and cost.

It should further be apparent that the terms "styrenic monomer" and "diene monomer" are not limited to styrene and butadiene, although these are the two preferred monomers in the second embodiment of the binder precursor composition.

It is also within the invention for the backbone carbon atoms of the copolymer to have pendant groups, such as alkyl groups (straight, branched, or cyclic), aryl, substituted aryl, solubilizing moieties such as the COO moiety and the like.

The "acrylate monomer" for use in the first binder precursor embodiment may be selected from acrylate monomers known generally in the art including acrylated isocyanurate monomers (such as the triacrylate of tris (hydroxyethyl) isocyanurate), acrylated urethanes, acrylated epoxies, and isocyanate derivatives having at least one pendant acrylate group. It is to be understood that mixtures of the above resins could also be employed. The terms "acrylate" and "acrylated" are meant to include monoacrylated, monomethacrylated, multi-acrylated, and multi-methacrylated monomers.

One preferred aqueous dispersible copolymer for use in the first binder precursor embodiment of the invention is that known under the trade designation "Rhoplex ST-954", commercially available from Rohm and Haas, Philadelphia, PA. This copolymer is derived from ethylacrylate, butylacrylate, methylmethacrylate, and methylolacrylamide. This composition also contains about 0.05 % formaldehyde. Some properties of this particular copolymer, as given in the Rohm and Haas publication dated April 1992 entitled "Rhoplex ST-954", are as follows:

| | |
|---|---|
| appearance | milky white |
| solids content, % | 45.5 |
| pH | 3.5 |
| glass trans. temp. (°C.) | −23 |
| minimum film forming temperature, °C. | <0 |
| density, lb./U.S. gal | 8.7 |
| specific gravity | 1.04 |
| ionic charge | anionic |
| viscosity, centipoise | 40. |

The styrenic monomer for use in the second binder precursor embodiment may be selected monomers known generally in the art including styrene, p-ethyl styrene, p-divinylbenzene, α-bromostyrene, cinnamyl bromide, and the like. It is to be understood that mixtures of these could also be employed. Particularly preferred is styrene.

The diene monomer for use in the second binder precursor embodiment functions to provide flexibility in the binder. Suitable diene monomers may be selected from diene monomers known generally in the art including butadiene, 2-methyl-1,3-butadiene, 2,3-dimethyl-1,3-butadiene, 1,4-pentadiene, and the like.

The useful copolymers of the second binder embodiment preferably do not have to be polymerized by the user, since copolymer dispersions are commercially available, such as the copolymer of styrene and butadiene known under the trade designation "RES 5900", available from Rohm and Haas Company, Philadelphia, PA. This product comprises about 49–52 weight percent copolymer, having less than 0.1 weight percent residual monomers, a maximum of 0.2 weight percent ammonia, and the balance water.

Preferably, the $T_g$ of the copolymer is no greater than about 100° C., more preferably no greater than about 0° C. Copolymers having $T_g$ more than about 50° C. are undesirable from the standpoint of hardness and resultant gloss improvement of surfaces treated using the inventive nonwoven surface treating articles.

The concentration of the copolymer useful in the invention may range from about 30% solids to about 60% solids, more preferably from about 40 to about 50% solids, particularly from 44 to 46% solids. Copolymer concentrations higher than about 60% solids are not easily coatable, and lower than about 30% solids do not contribute to gloss improvement and increase the energy required to evaporate water.

C. Polyols

The polyol component functions to soften the binder in much the same fashion as the above-mentioned copolymer component, and also contributes to the ability of the nonwoven articles of the invention to improve gloss of various surfaces when used to condition a surface.

Polyols useful in the invention are typically and preferably polyvinyl alcohols (PVA), including hydrolyzed copolymers of vinyl esters, particularly hydrolyzed copolymers of vinyl acetate and the like.

One particularly preferred group of polyols is group of partially hydrolyzed polyvinyl acetate-derived PVAs known under the trade designation "Elvanol", especially the grade having the designation "51-05". Also suitable are grades "52-22" and "50-42" (both "partially hydrolyzed") and "90-50" and "71-30" (both "fully hydrolyzed"). The various grades are described in Du Pont publication entitled "Elvanol Product and Properties Guide", publication date unknown. As defined by Du Pont, "fully hydrolyzed" means the polyvinyl acetate is 98% or above hydrolyzed, while resins with lower than 98% hydrolysis are referred to as "partially hydrolyzed."

The partially hydrolyzed versions are preferred over the fully hydrolyzed versions since the fully hydrolyzed versions are more viscous. Viscosity of the various grades increases with increasing degree of polymerization, and decreases with increasing temperature. The materials having higher viscosities may tend to produce lower "gloss recovery" defined to mean simply the difference between the initial gloss before surface condition and the gloss after surface conditioning. The higher viscosity materials are also disadvantageous from the standpoint of coating, since higher viscosity materials tend not to be easily coated using convention roll coating techniques.

The PVA known under the trade designation "Elvanol" grade "51-05" has a viscosity of 5–6 mPa-s (centipoise) when measured using a 4% solids aqueous solution at 20° C., determined by Hoeppler falling ball method; a percent hydrolysis ranging from 87 to 89% (mole % of acetate hydrolyzed, dry basis); and solution pH (negative base ten logarithm of the hydrogen ion concentration) ranging from 5.0–7.0. The PVAs known under the trade designation "Elvanol" generally have a melting point ranging from about 200 to about 220° C., a decomposition temperature ranging from about 210 to about 240° C. and glass transition temperature ranging from about 75 to about 85° C.

Other polyols useful in the invention include polyester polyols and polyether polyols. Polyether polyols are addition products derived from cyclic ethers such as ethylene oxide, propylene oxide, tetrahydrofuran, and the like.

Polyester polyols are macroglycols (glycols having greater than about 5 repeat units) with a low acid number and low water content, and typically have a molecular weight (number average) of about 2000.

Polyester polyols for use in the present invention can be made by the reaction of caprolactone with a suitable glycol such as ethylene glycol, propylene glycol, diethylene glycol, dipropylene glycol, 1,4-butanediol, and 1,6-hexanediol. The reaction of caprolactone with a suitable diol yields a polycaprolactone, $$HOR^6-[OC(\overset{O}{\overset{\|}{C}}H_2)_5O]_y-H$$

where y is limited to values which will not exceed the viscosity limitations mentioned herein for coatable compositions of the invention. Preferably y ranges from about 10 to 100.

Molar percentages of polyol in the coatable compositions are preferably no more than about 20 percent, more preferably ranging from about 4 to about 12 percent of the total moles of reactants. Exceeding the upper limit may produce polyurethane binders which have less resistance to abrasion, while using less than 4 mole percent in conjunction with a crosslinking agent mole percentage exceeding about 60 produces crosslinked polyols which may be difficult to coat onto nonwoven webs.

D. Melamine Crosslinking Agent

The primary function of the melamine crosslinking agent in the binders of the first embodiment mentioned above is to at least partially crosslink the acrylate/acrylamide copolymer dispersion and the polyol component, forming linkages which gather to form "hard" regions in the binder. Formaldehyde will be generated during these reactions from the decomposition of the melamine. The melamine crosslinking agent is used to improve the water and solvent resistance of the inventive nonwoven surface treating articles of the invention, and to increase their firmness. The degree of firmness is a function of the specific melamine crosslinking agent used.

Compounds useful as melamine crosslinking agents in the coatable, thermally condensable binder precursor compositions within the invention include melamine and substituted versions thereof within the general formula

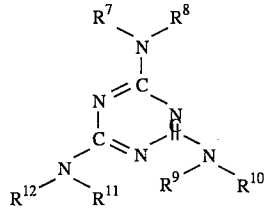

(II)

wherein $R^7$, $R^9$, and $R^{11}$ are independently selected from the group consisting of H and $C_1$–$C_{10}$ (inclusive) alkyl groups (normal, branched, or cyclic) bearing one or more hydroxyl groups, and $R^8$, $R^{10}$, and $R^{12}$ are independently selected from the group consisting of H, $C_1$–$C_{10}$ (inclusive) alkyl groups (normal, branched, or cyclic) bearing one or more hydroxyl groups, and $C_1$–$C_{10}$ (inclusive) alkyl ether groups (normal, branched, or cyclic).

One particularly preferred melamine crosslinking agent within general formula (III), particularly useful in binders of the first embodiment, is that known under the trade designation "Cymel 373" also from American Cyanamid. This product is the compound having all R groups being —$CH_2OH$. Another preferred melamine crosslinking agent within general formula (III), particularly useful in binders of the second embodiment, is that known under the trade designation "Cymel 303", commercially available from American Cyanamid, Wayne, N.J. This product is the compound having $R^7$, $R^9$, and $R^{11}$ each being —$CH_2OH$, with $R^8$, $R^{10}$, and $R^{12}$ each being —$CH_2$—O—$CH_3$.

E. Optional Binder Precursor and Binder Components

Binder precursor compositions and cured binders suitable for use in the invention may contain nonabrasive fillers, pigments, and other materials which are desired to alter the final properties of the nonwoven surface treating articles of the invention. In particular, in the floor finishing field, the color of the nonwoven surface treating articles serves to characterize the article (white being the least abrasive, darker colors indicating more abrasive). Thus, the resins, binder precursor solutions, and binders useful in the invention are preferably compatible or capable of being rendered compatible with pigments.

Fillers may be added to the binder precursor compositions to produce thixotropic compositions which are easier to coat onto nonwoven webs and reduce the tendency of the ingredients to separate into two or more phases. Fillers such as calcium carbonate and amorphous silica are particularly preferable. One preferred calcium carbonate is that known under the trade designation "Hubercarb" Q 325, available from Huber, Quincy, Ill. Fillers, if used, generally comprise no more than about 40 weight percent of the cured binder on a dry weight basis, since beyond this amount the strength of the binder decreases.

Antifoaming agents are sometimes used during production of the inventive binder precursors. If used, generally no more than about 0.1 weight percent is employed when used (dry basis).

Catalysts are optional, but may be employed to catalyze the crosslinking of the acrylate/acrylamide copolymer, melamine crosslinking agent, and/or polyol. If used, the catalyst is typically and preferably applied to the binder precursor-coated nonwoven (i.e. after the web has been coated with binder precursor composition absent catalyst).

Examples of suitable catalysts include, ammonium nitrate, diammonium phosphate, p-toluene sulfonic acid, and the like. Typically no more than about 2 weight percent (dry basis) is employed when used.

Surfactants (wetting agents) may be employed, such as that known under the trade designation "DC Q2-3168" (a silicone emulsion surfactant available from Dow Corning, Midland, Mich.), and the like, at weight percent ranging from 0 to about 2 weight percent (dry basis).

Binder precursor compositions and binders of the first and second embodiments may optionally comprise any thermoplastic or thermoset resin suitable for manufacture of nonwoven articles, but it will be clear to those skilled in the art of nonwoven manufacturing the binder in its final, cured state must be compatible (or capable of being rendered compatible) with the fibers of choice.

The binder preferably adheres to all of the types of fibers in a particular nonwoven article of the invention, thus deterring (preferably preventing) the subsequently made nonwoven surface treating article from becoming prematurely worn during use. In addition, binders suitable for use in the invention preferably adhere to abrasive particles (if used) so as to prevent the particles from prematurely loosening from the nonwoven surface treating articles of the invention during use, but should allow the presentation of new abrasive particles to the surface being treated.

Another consideration is that the binder should be soft enough to allow the nonwoven surface treating articles of the invention to be somewhat flexible during use as a polishing pad so as to allow the pad to conform to irregularities in the floor. However, the binder should not be so soft as to cause undue frictional drag between the nonwoven surface treating articles of the invention and the floor being treated. In the case of the articles of the invention being attached to a conventional electric- or propane-powered floor burnishing machine, high frictional drag may lead to actual removal of any previously applied surface finish.

Suitable binders will not readily undergo unwanted reactions, will be stable over a wide pH and humidity ranges, and will resist moderate oxidation and reduction. The binder precursor composition should be stable at higher temperatures and have a relatively long shelf life.

Optional resins may be added to the binder precursor compositions, partially substituting for the acrylate/acrylamide copolymer or styrenic/diene copolymer and/or polyol components, as the case may be. The percent substitution varies depending on the chemical nature of the proposed optional resin, but generally does not exceed 20 weight percent (dry basis). Such optional binders may comprise a wide variety of resins, including synthetic polymers such as styrene-butadiene (SBR) copolymers, carboxylated-SBR copolymers, melamine resins other than the melamine curing agents mentioned above, phenol-aldehyde resins, polyesters, polyamides, polyureas, polyvinylidene chloride, polyvinyl chloride, acrylic acid-methylmethacrylate copolymers, acetal copolymers, polyurethanes, and mixtures and cross-linked versions thereof. The amounts of such optional resins will vary with the specific acrylate/acrylamide or styrenic/diene copolymer, melamine crosslinking agent, polyol, and urea derivative employed, as well as their respective amounts.

Preferred coatable binder precursor compositions of the first embodiment of the invention are presented in Table A (percent by weight, solids basis). Preferred coatable binder precursor compositions of the second embodiment of the invention are presented in Table B (percent by weight, solids basis).

If the nonwoven abrasive articles comprise a substantial amount of polyamide (e.g., nylon 6,6) fibers, other resins may be preferred as the resin component of the binder. Examples of suitable optional binders for partially substituting for the polyol and/or aqueous dispersible copolymer components for use when the fibers comprise polyamides include: phenolic resins, aminoplast resins, urethane resins, urea-aldehyde resins, isocyanurate resins, and mixtures thereof. Resole phenolic resins are described in Kirk-Othmer, *Encyclopedia of Chemical Technology,* 3rd Ed., John Wiley & Sons, 1981, N.Y., Vol. 17, p. 384–399, incorporated by reference herein.

Examples of commercially available phenolic resins include those known by the trade names "Varcum" and "Durez" (from Occidental Chemicals Corp., N. Tonawanda, N.Y.), and "Arofene" (from Ashland Chemical Co.).

In one preferred method for making the nonwoven surface treating articles of the invention, a coatable binder precursor composition, comprising uncured resin and other ingredients, such as fillers, depending on the coating procedure, is applied to a nonwoven web using roll coating. Then, during further processing, the binder precursor is cured or polymerized to form a cured binder. Other coating methods may of course be employed as are known in the art, such as spray coating, and the like. The binder precursor composition may be alternatively applied to the web with abrasive particles in the composition, with the abrasive particles electrostatically or mechanically deposited onto the web.

TABLE A

Preferred Binder Precursor Compositions*

| Ingredient | Broad wt % Range | Preferred wt % Range |
|---|---|---|
| acrylate/acrylamide ("Rhoplex ST-954") | 30–85 | 50–80 |
| melamine crosslinking agent ("Cymel 373") | 1–25 | 1–15 |
| urea | 2–30 | 5–25 |
| PVA ("Elvanol 51-05") | 1–30 | 1–10 |
| $CaCO_3$ filler ("Hubercarb Q 325") | 1–30 | 10–20 |
| catalyst** (sol. of ammonium nitrate) | 0–2.0 | 0–1.5 |
| antifoam agent** | 0–1.0 | 0.01–1.0 |

TABLE A-continued

| Preferred Binder Precursor Compositions* | | |
|---|---|---|
| Ingredient | Broad wt % Range | Preferred wt % Range |
| surfactant** | 0–2.0 | 0–1.0 |

*weight percent solids basis
**optional ingredient

TABLE B

| Preferred Binder Precursor Compositions* | | |
|---|---|---|
| Ingredient | Broad wt % Range | Preferred wt % Range |
| styrene/butadiene latex ("RES 5900") | 40–99.9 | 50–70 |
| melamine crosslinking agent** ("Cymel 303") | 0–15 | 0–7.5 |
| urea** | 0–15 | 0–5 |
| PVA ("Elvanol 51-05") | 0.1–12 | 0.1–5 |
| $CaCO_3$ filler** ("Hubercarb Q 325") | 0–35 | 0–30 |
| catalyst** (sol. of diammonium phosphate) | 0–2.0 | 0–1.5 |
| antifoam agent** | 0–1.0 | 0.01–1.0 |
| surfactant** | 0–2.0 | 0–1.0 |

*weight percent solids basis
**optional ingredient

II. Nonwoven Webs

The open, lofty, nonwoven surface treating articles of the present invention are preferably made from crimped, staple, thermoplastic organic fibers such as polyamide and polyester fibers. Although crimping is not necessary to the invention, crimped, staple fibers can be processed and entangled into nonwoven webs by conventional web-forming machines such as that sold under the tradename "Rando Webber" which is commercially available from the Curlator Corporation. Methods useful for making nonwoven webs suitable for use in the invention from crimped, staple, synthetic fibers are disclosed by Hoover, et al., in U.S. Pat. Nos. 2,958,593 and 3,537,121, which are incorporated herein by reference. Continuous crimped or uncrimped fibers may also be used, but these tend to increase frictional drag of the article.

The staple fibers may be stuffer-box crimped, helically crimped as described, for example, in U.S. Pat. No. 4,893,439, or a combination of both, and the nonwoven webs useful in making nonwoven surface treating articles of the invention may optionally contain up to about 50 weight percent melt-bondable fibers, more preferably from about 20 to about 30 weight percent, to help stabilize the nonwoven web and facilitate the application of the coating resin.

Suitable staple fibers known in the art are typically made of polyester or polyamide, although it is also known to use other fibers such as rayon.

Melt-bondable fibers useful in the present invention can be made of polypropylene or other low-melting polymers such as polyesters as long as the temperature at which the melt-bondable fibers melt and thus adhere to the other fibers in the nonwoven web construction is lower than the temperature at which the staple fibers or melt-bondable fibers degrade in physical properties. Suitable and preferable melt-bondable fibers include those described in U.S. Pat. No. 5,082,720, mentioned above. Melt-bondable fibers suitable for use in this invention must be activatable at elevated temperatures below temperatures which would adversely affect the helically crimped fibers. Additionally, these fibers are preferably coprocessable with the helically crimped fibers to form a lofty, open unbonded nonwoven web using conventional web forming equipment. Typically, melt-bondable fibers have a concentric core and a sheath, have been stuffer box crimped with about 6 to about 12 crimps per 25 mm, and have a cut staple length of about 25 to about 100 mm. Composite fibers have a tenacity of about 2–3 g/denier. Alternatively, melt-bondable fibers may be of a side-by-side construction or of eccentric core and sheath construction.

Preferred fibers for use in this invention are helically crimped polyester staple fibers and stuffer box crimped polyester staple fibers, particularly helically crimped polyethylene terephthalate (PET) staple fibers and stuffer box crimped PET staple fibers.

U.S. Pat. No. 3,595,738, incorporated herein by reference, discloses methods for the manufacture of helically crimped bicomponent polyester fibers suitable for use in this invention. The fibers produced by the method of that patent have a reversing helical crimp. Fibers having a reversing helical crimp are preferred over fibers that are crimped in a coiled configuration like a coiled spring. However, both types of helically crimped fibers are suitable for this invention. U.S. Pat. Nos. 3,868,749, 3,619,874, and 2,931,089, all of which are incorporated herein by reference, disclose various methods of edge crimping synthetic organic fibers to produce helically crimped fibers.

Helically crimped fibers typically and preferably have from about 1 to about 15 full cycle crimps per 25 mm fiber length, while stuffer box crimped fibers have about 3 to about 15 full cycle crimps per 25 mm fiber length. As taught in the '439 patent, when helically crimped fibers are used in conjunction with stuffer box crimped fibers, preferably the helically crimped fibers have fewer crimps per specified length than the stuffer box fibers.

Crimp index, a measure of fiber elasticity, preferably ranges from about 35 to about 70 percent for helically crimped fibers, which is about the same as stuffer box crimped fibers. Crimp index can be determined by measuring fiber length with appropriate "high load" attached, then subtracting fiber length with appropriate "low load" attached, and then dividing the result value by the high load fiber length and multiplying that value by 100. (The values of the appropriate "high load" and "low load" depend on the fiber denier. For fibers of the invention having 50 100 denier, low load is about 0.1–0.2 grams, high load is about 5–10 grams.) The crimp index can also be determined after exposing the test fibers to an elevated temperature, e.g., 135° C. to 175° C. for 5 to 15 minutes, and this value compared with the index before heat exposure. Crimp index measured after the fiber is exposed for 5 to 15 minutes to an elevate temperature, e.g., 135° C. to 175° C., should not significantly change from that measured before the heat exposure. The load can be applied either horizontally or vertically.

The length of the fibers employed is dependent on upon the limitations of the processing equipment upon which the nonwoven open web is formed. However, depending on types of equipment, fibers of different lengths, or combinations thereof, very likely can be utilized in forming the lofty open webs of the desired ultimate characteristics specified herein. Fiber lengths suitable for helically crimped fibers preferably range from about 60 mm to about 150 mm, whereas suitable fiber lengths for stuffer box fibers range from about 25 to about 70 mm.

The thickness (denier) of the fibers used in the nonwoven surface treating articles of the present invention is not critical. As is generally known in the nonwoven field, larger denier fibers are preferred for more abrasive articles, smaller denier fibers are preferred for less abrasive articles, and fiber size must be suitable for lofty, open, low density abrasive products. The denier of fibers typically used for nonwoven abrasive articles of the invention may range broadly from about 6 to about 400, preferably from 15 to about 200 denier, more preferably from about 50 to about 100 denier. Finer deniers than about 15 may result undesirable frictional drag when the nonwoven surface treating articles of the invention are attached to conventional floor machines (i.e., one designed to rotate and force the abrasive article against the surface and thus finish the surface). Fiber deniers larger than about 200 may reduce drag, but torque from the floor machine may twist the web rather than rotate the web as is desired.

Natural fibers may also be employed, preferably in combination with synthetic fibers. Vegetable fibers such as hemp, jute, and the like, may be used, and animal hair fibers may employed. One preferred animal hair fiber is hog's hair fiber. If natural fibers are employed, they preferably and typically range from about 0 to about 30 weight percent of the total weight of fibers.

Uncoated fibrous webs useful in the invention typically and preferably have a weight ranging from about 300 to about 1000 grams/meter$^2$ ("gsm"), more preferably ranging from about 300 to about 600 gsm. The binder coating weight on the fibrous web is generally about 1.0 to about 4.0 times the weight of the uncoated web, more preferably form about 1.0 to about 3.0 times the weight of the uncoated web.

The nonwoven surface treating articles of the invention may be attached to and used with conventional burnishing machines, such as those known under the trade designations Pioneer "2100" Super Buffer, from Pioneer Co., Sparta, N.C., which is a propane driven machine, and Clarke "2000" Burnisher, from Clarke Co., Denver, Colo. an electric machine. For efficient operation using these types of machines, the nonwoven surface treating articles of the invention preferably have a non-compressed thickness of at least about 0.5 cm, more preferably ranging from about 2 cm to about 4 cm. As mentioned above, the thickness is dependent upon the fiber denier chosen for the particular application. If the fiber denier is too fine, the nonwoven surface treating articles of the invention will be less lofty and open, and thus thinner, resulting in the article tending to be more easily loaded with floor finish and/or detritus from the floor or surface being treated.

III. Abrasive Particles

In optional nonwoven surface treating article embodiments within this invention, the nonwoven web is coated with an binder precursor composition as herein described, and further includes abrasive particles.

Abrasive particles, when employed, are preferably dispersed throughout and adhered to the fibers of the three-dimensional nonwoven web by the binder. Abrasive particles useful in the nonwoven surface treating articles of the present invention may be individual abrasive grains or agglomerates of individual abrasive grains.

The abrasive particles may be of any known soft or hard abrasive material commonly used in the abrasives art. Soft abrasive particles are those having hardness from 1 to 7 Mohs, while hard abrasive particles have hardness greater than about 8. Examples of useful soft abrasive particles include garnet, flint, silica, and pumice, and such organic polymeric materials such as polyester, polyvinyl chloride, methacrylate, methylmethacrylate, polymethylmethacrylate, polycarbonate and polystyrene. Examples of useful hard abrasive particles include garnet (7 Mohs), aluminum oxide (9+Mohs), silicon carbide (9+Mohs), topaz, fused alumina-zirconia, boron nitride, tungsten carbide, and silicon nitride.

The abrasive particles are preferably present in a coatable binder precursor composition at a weight percent (per total weight of coatable composition) ranging from about 0 to about 35 weight percent, more preferably from about 0 to about 20 weight percent.

The abrasive particles, if employed, are not required to be uniformly dispersed on the fibers of the nonwoven articles, but a uniform dispersion may provide more consistent abrasion characteristics.

IV. Method of Polishing Vinyl Tile Floors

The method of the invention comprises forcefully contacting a surface with a nonwoven surface treating article of the invention while causing relative movement between the surface and the article. The method and articles of the invention are particularly adept at buffing and polishing vinyl tile floors having surface coating finishes thereon, such as that known under the trade designation "Sprint" from S. C. Johnson & Son, Racine, Wis., and the like. "Sprint" is an ultra high-speed floor finish comprising styrene-acrylonitrile copolymer crosslinked with zinc ammonium carbonate.

The articles of the invention are preferably attached to a conventional burnishing machine (for example propane or electric powered) adapted to operate at high speed (1000–4000 rpm). The exact machine, pad, rotary buffing speed, and weight are not critical to the practice of the invention. In the case of conventional floor machines, the nonwoven surface treating articles of the invention will preferably have a diameter ranging from about 25 to about 75 cm, more preferably ranging from about 40 to about 60 cm.

In the Test Procedures and Examples which follow, all parts and percentages are by weight.

TEST PROCEDURES

GLOSS

In order to test the efficacy of the binders and nonwoven articles of the invention to improve the gloss of dulled surfaces while emitting less formaldehyde, conventional propane and electric powered burnishing machines were each equipped with one 50.8 cm diameter nonwoven article to test the inventive nonwoven articles for gloss improvement.

The test procedure was as follows: white composition vinyl test tiles (305 mm by 305 mm) were coated with 4 coatings of the floor finish known under the trade designation "Sprint" from S. C. Johnson & Son, Racine, Wis. (an ultra high-speed floor finish comprising styrene-acrylonitrile copolymer crosslinked with zinc ammonium carbonate), allowing 30 minutes for drying between coatings. The coated tiles were allowed to stand for at least 24 hours before being used in this test.

The coated tiles were then pretreated (dulled) with a nonwoven pad (any pad which is mildly abrasive could have been used). The nonwoven pad used for dulling the tiles used in the Examples to follow was that known under the trade designation "LP 96" 3M General Purpose Commercial Scouring Pad, available from Minnesota Mining & Manufacturing Co., St. Paul, Minn. The dulling procedure produced a uniform and reproducible starting surface on the test tiles having glossmeter reading less than 10° at 60° viewing angle when using natural fiber webs, and glossmeter reading between 10 and 20 for polyester speed burnish webs, using American Society of Testing and Materials ("ASTM") D-523.

One 50.8 cm diameter test nonwoven (inventive or comparative) was then attached to the particular machine as indicated in the examples. Then the machine was started and run across the test tiles such that the floor pad and the test tile came into contact for one pass (one pass is defined as passing the rotating pad in contact with the tile at a rate of about 45m/minute). After one burnishing pass ("burnishing" refers to using high rotary speed to increase gloss on a surface), the test tile in each case was rinsed with water and wiped dry.

The 60° glossmeter geometry gloss measurement, roughly seven per test tile/test nonwoven combination, were made after burnishing, and the average of these recorded. Test method ASTM D-523 was followed for determining specular gloss values. Note that "60° glossmeter geometry gloss" value (i.e., incident light reflected from the test surface at incident angle measured 60° from vertical) relates to the "shininess" of the surface and correlates to the appearance of the floor about 3 meters in front of the observer. A reading off a glossmeter is an indexed value, with a value of "100" given to the glossmeter reading (from any angle) from a highly polished, plane, black glass with a refractive index of 1.567 for the sodium D line. The incident beam is supplied by the tester itself. A value of 0 is no or very low gloss, while "high gloss" at 60° geometry is about 75 or greater (or 30 or greater at 20° geometry), which are preferred. A glossmeter known under the trade designation "Micro-TRI", from BYK Gardner, was used.

EXAMPLES 1–12 and Comparative Examples A and B

Examples 1–6 used a low density prebonded web formed by a conventional web making machine (trade designation "Rando Webber"). The web formed was a blend of fibers comprising 75 weight percent of 84 mm long, 50 denier stuffer box crimped polyethylene terephthalate ("PET") polyester staple fibers having crimp index of 26%, and 25 weight percent of 58 mm long, 25 denier crimped sheath-core melt-bondable polyester staple fibers (core comprising polyethylene terephthalate, sheath comprising copolyester of ethylene terephthalate and isophthalate) having about 5 crimps per 25 mm and a sheath weight of about 50 percent. The formed web was heated in a hot convection oven for about three minutes at 160° C. to bond the melt-bondable fibers together at points of intersection to form a prebond web. The prebonded web weighed about 523 gsm. Six discs of 50.8 cm diameter were cut from this web for Examples 1–6, and designated "web 1" in Table 3.

Another web was similarly made comprising 20 weight percent hog hair (referred to as "web 2" in Table 3), 25 weight percent 58 mm long, 25 denier crimped sheath-core melt-bondable polyester staple fibers (core comprising polyethylene terephthalate, sheath comprising copolyester of ethylene terephthalate and isophthalate) having about 5 crimps per 25 mm and a sheath weight of about 50 percent, and 55 weight percent of 84 mm long, 50 denier stuffer box crimped polyethylene terephthalate ("PET") polyester staple fibers having crimp index of 26%. Six discs of 50.8 cm diameter were cut from this web for examples 7–12.

Six binder precursor compositions within the invention A-F were prepared by combining the ingredients in the amounts indicated in Table 2.

General procedure "A" was to first introduce the urea into the acrylate/acrylamide copolymer and then dissolve the urea with continuous stirring at room temperature (about 25° C.). Then the crosslinking agent was added with stirring, followed by the $CaCO_3$ with continued stirring. Finally the PVA was added and stirred until dissolved. Water was added as necessary to decrease viscosity of the compositions.

An alternative procedure "B" was to introduce the urea and PVA into the acrylate/acrylamide copolymer and then dissolve the urea and PVA, also with continuous stirring at room temperature. Then the crosslinking agent was added with stirring, followed by the $CaCO_3$ with continued stirring. Water was added as necessary to decrease viscosity of the compositions. These compositions tended to foam, but gave good results for improving gloss.

TABLE 2*

| | Binder precursor composition** | | | | | |
|---|---|---|---|---|---|---|
| Ingredient | A | B | C | D | E | F |
| acrylate/ acrylamide ("Rhoplex ST-954") | 65 | 54 | 52.6 | 34 | 35.5 | 30 |
| melamine crosslinking agent ("Cymel 373") | 3 | 8 | 9.8 | 19 | 19 | 16 |
| urea | 5 | 16 | 19.6 | 19 | 21 | 17 |
| PVA ("Elvanol 51-05") | 9 | 5 | 1.6 | 20 | 2.5 | 17 |
| $CaCO_3$ filler ("Hubercarb Q 325") | 18 | 17 | 16.4 | 8 | 22 | 20 |

*weight percent, dry basis
**Binder precursors A–F used General procedure "A"

The binder precursor compositions A–F were each separately applied to one of the twelve prebonded webs by passing the prebond web between the coating rolls of a two roll coater, adding binder precursor composition equal to 2.2 times the weight of the uncoated web for "web 1", and 2.0 times for "web 2". The rotating lower roll, which was partially immersed in the binder precursor composition, carried the composition to the prebond webs so as to evenly disperse the compositions throughout each web structure. The wet prebond webs were dried and the saturant cured in a hot air oven at 150° C. for about 25 minutes (lower temperatures could be used with longer residence times). Test discs (50.8 cm diameter) were cut from the cured webs, and are tabulated in Table 3, with "web 1" and "web 2" as described above being denoted in Table 3.

Comparative Example A consisted of a nonwoven surface treating article made in accordance with Example 1 of U.S. Pat. No. 5,030,496 (McGurran), made from a web bonded together with a binder resin comprising plasticized vinyl resin and a condensation polymerized amine-formaldehyde derivative. This article, although improving 60° gloss, emitted considerable formaldehyde, as detect by smell.

Comparative Example B comprised a commercially available animal fiber-based surface treating article known under the trade designation "3M Brand Natural Blend High Speed Burnishing Pad", from 3M, St. Paul, Minn. As with Comparative Example A, this article improved 60° gloss somewhat but also emitted considerable formaldehyde, as detected by smell.

TABLE 3

| Example Disc | Web | Binder | 60° Gloss Initial, Final (electric) [propane] |
|---|---|---|---|
| 1 | 1 | A | 13–15, (33) [47] |
| 2 | 1 | B | 13–15, (36) |
| 3 | 1 | C | 13–15, (45) [65] |
| 4 | 1 | D | 13–15, (28) |
| 5 | 1 | E | 13–15, (35) [39] |
| 6 | 1 | F | 13–15, (36) [41] |
| 7 | 2 | A | 5–7, (37) [50] |
| 8 | 2 | B | 5–7, (26) |
| 9 | 2 | C | 5–7, (36) [46] |
| 10 | 2 | D | 5–7, (20) |
| 11 | 2 | E | 5–7, (30) |
| 12 | 2 | F | 5–7, (22) |
| A | 1 | PVC/melamine | 13–15, (25) [45] |
| B | 2 | polyol | 5–7, (27) [37] |

EXAMPLES 13–14, and Comparative Example C

Test were run to determine the amount of formaldehyde emitted from the binder precursor composition of the invention and the binder used in U.S. Pat. No. 5,030,496 (Comparative Example C) during curing. Each sample of binder precursor to be tested contained 0.40 grams of solids. A volume of each sample to be tested was placed into a forced air circulation oven at a temperature of 160° C. A tube was connected to the top of the oven in a position to continuously sample the vapor generated from each sample tested. A formaldehyde emissions tester known under the trade designation "Interscan" (model #1160) from Interscan Corporation was connected to the opposite end of the tube. The samples were heated at 160° C. for a total of 15 minutes. Table 4 indicates the results of this test for Example binder precursor compositions A (Example 13) and C (Example 14) and Comparative binder precursor C.

TABLE 4

| | Formaldehyde Emissions (ppm)* | | | |
|---|---|---|---|---|
| time (sec.) | Comp. Ex. C | Ex. 13 | Ex. 14 | |
| 0 | 0 | 0 | 0 | 0.0 |
| 25 | 1 | 0 | 0 | 0.4 |
| 50 | 4.5 | 0 | 0.01 | 0.8 |
| 75 | 7.5 | 0.01 | 0.025 | 1.2 |
| 100 | 8.3 | 0.05 | 0.045 | 1.7 |
| 125 | 7.5 | 0.1 | 0.065 | 2.1 |
| 150 | 6.9 | 0.16 | 0.075 | 2.5 |
| 175 | 6.2 | 0.2 | 0.085 | 2.9 |
| 200 | 5.65 | 0.21 | 0.09 | 3.3 |
| 225 | 5.2 | 0.2 | 0.1 | 3.8 |
| 250 | 4.8 | 0.18 | 0.1 | 4.2 |
| 275 | 4.4 | 0.15 | 0.1 | 4.6 |
| 300 | 4.2 | 0.12 | 0.1 | 5.0 |
| 325 | 4 | 0.09 | 0.1 | 5.4 |
| 350 | 3.8 | 0.08 | 0.1 | 5.8 |
| 375 | 3.6 | 0.06 | 0.09 | 6.2 |
| 400 | 3.5 | 0.05 | 0.08 | 6.7 |
| 425 | 3.4 | 0.03 | 0.075 | 7.1 |
| 450 | 3.28 | 0.01 | 0.075 | 7.5 |
| 475 | 3.14 | 0.01 | 0.065 | 7.9 |

TABLE 4-continued

| | Formaldehyde Emissions (ppm)* | | | |
|---|---|---|---|---|
| time (sec.) | Comp. Ex. C | Ex. 13 | Ex. 14 | |
| 500 | 3.1 | 0.01 | 0.06 | 8.3 |
| 525 | 2.95 | 0.01 | 0.06 | 8.8 |
| 550 | 2.91 | 0 | 0.05 | 9.2 |
| 575 | 2.8 | 0 | 0.05 | 9.6 |
| 600 | 2.72 | 0 | 0.05 | 10.0 |
| 625 | 2.68 | 0 | 0.05 | 10.4 |
| 650 | 2.58 | 0 | 0.05 | 10.8 |
| 675 | 2.5 | 0 | 0.04 | 11.2 |
| 700 | 2.43 | 0 | 0.04 | 11.7 |
| 725 | 2.38 | 0 | 0.04 | 12.1 |
| 750 | 2.31 | 0 | 0.03 | 12.5 |
| 775 | 2.3 | 0 | 0.03 | 12.9 |
| 800 | 2.2 | 0 | 0.02 | 13.3 |
| 825 | 2.22 | 0 | 0.02 | 13.8 |
| 850 | 2.18 | 0 | 0.02 | 14.2 |
| 875 | 2.1 | 0 | 0.02 | 14.6 |
| 900 | 2 | 0 | 0.02 | 15.0 |

*ppm = parts per million

EXAMPLE 15

A binder precursor composition made in accordance with the second embodiment was prepared consisting of 60.5 parts styrene/butadiene copolymer latex (49–52 weight percent solids) known under the trade designation "RES 5900" (Rohm and Haas, Philadelphia, Pa.); 7.5 parts melamine curing agent known under the trade designation "Cymel 303" (American Cyanamid, Wayne N.J.); 29.6 parts $CaCO_3$ known under the trade designation "Hubercarb Q-325", from Huber Corp , Quincy Ill.; 0.7 part diammonium phosphate (40% solution in water, from Hawkins Chemical,Inc., Minneapolis, Minn.); and 1.8 part polyvinyl alcohol known under the trade designation "Elvanol 51-05" (25% in water, from Dupont, Wilmington, Del.). This binder was prepared by first introducing the melamine curing agent into the styrene copolymer with continuous stirring at room temperature (about 25° C.). Then the diammonium phosphate was added with stirring, followed by the $CaCO_3$ with continued stirring. Finally the PVA was added and stirred until dissolved. Water was added as necessary to decrease viscosity of the composition.

This binder precursor was applied via a two roll coater to nonwoven webs identical to those used in Examples 1–6. The coating weight add on was equal to 2.2 times the weight of the uncoated web. A disc was cut from this web and attached to the electric burnishing machine and tested for gloss improvement on vinyl tiles having floor finish, all as above described. The 20° initial gloss was 4, and 20° final gloss was 10, while the 60° initial gloss was 12, with a 60° final gloss reading of 34.

While this invention has been described in connection with specific embodiments, it should be understood that it is capable of further modification. The claims herein are intended to cover those variations which one skilled in the art would recognize as the chemical and physical equivalent of what has been described herein.

What is claimed is:

1. A flexible and resilient, fibrous surface treating article comprising an open, lofty, nonwoven fibrous web formed of entangled fibers bonded together at points where they contact one another by a binder, the binder comprising 1) a copolymer of an acrylate monomer and an acrylamide monomer, 2) a crosslinked reaction product of a polyol and a melamine crosslinking agent, and 3) a reaction product of a urea derivative and formaldehyde.

2. Article in accordance with claim 1 wherein at least some of said fibers comprise synthetic fibers.

3. Article in accordance with claim 2 wherein at least some of said synthetic fibers comprise polyester staple fibers.

4. Article in accordance with claim 2 wherein at least some of said synthetic fibers comprise polyamide staple fibers.

5. Article in accordance with claim 2 wherein at least some of said synthetic fibers comprise melt-bonded staple fibers.

6. Article in accordance with claim 1 wherein at least some of said fibers comprise natural fibers.

7. Article in accordance with claim 1 wherein said urea derivative is urea.

8. Article in accordance with claim 1 wherein said urea derivative is selected from the group consisting of:

A) compounds selected from the group consisting of compounds represented by the general formula (I)

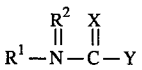

(I)

and mixtures thereof wherein X=O or S and Y=—$NR^3R^4$ or —$OR^5$, such that when X=S, Y=$NR^3R^4$, each of $R^1$, $R^2$, $R^3$, $R^4$ and $R^5$ is a monovalent radical selected from the group consisting of hydrogen, alkyl groups having 1 to about 10 carbon atoms, hydroxyalkyl groups having from about 2 to 4 carbon atoms and one or more hydroxyl groups, and hydroxypolyalkyleneoxy groups having one or more hydroxyl groups, and with the provisos that:

(i) said compound contains at least one —NH and one —OH group or at least two —OH groups or at least two —NH groups;

(ii) $R^1$ and $R^2$ or $R^1$ and $R^3$ can be linked to form a ring structure; and (iii) $R^1$, $R^2$, $R^3$, $R^4$ and $R^5$ are never all hydrogen at the same time;

B) compounds having molecular weight less than about 300 and selected from the group consisting of alkyl substituted 2-aminoalcohols, β-ketoalkylamides, and nitro alkanes;

C) poly(oxyalkylene) amines having molecular weight ranging from about 90 to about 1000; and D) poly(oxyalkylene) ureido compounds having molecular weight ranging from about 90 to about 1000, and combinations of any two or more of these.

9. Article in accordance with claim 1 wherein said copolymer is derived from ethylacrylate, butyl acrylate, methylmethacrylate, and methylolacrylamide.

10. Article in accordance with claim 1 wherein said polyol is derived from polyvinyl acetate.

11. Article in accordance with claim 1 wherein said melamine crosslinking agent is selected from the group consisting of melamine and substituted versions thereof within the general formula (II):

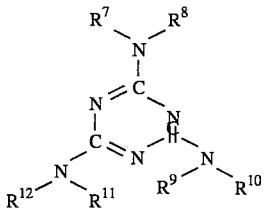

(II)

wherein $R^7$, $R^8$, $R^9$, $R^{10}$, $R^{11}$, $R^{12}$ are independently selected from the group consisting of H and $C_1$–$C_{10}$ (inclusive) alkyl groups bearing one or more hydroxyl groups.

12. Article in accordance with claim 11 wherein said melamine crosslinking agent comprises the compound having $R^7$, $R^8$, $R^9$, $R^{10}$, $R^{11}$, and $R^{12}$ each being —$CH_2OH$.

13. Article in accordance with claim 11 wherein said binder includes calcium carbonate.

14. A method of increasing the gloss of hard surfaces the method comprising contacting a nonwoven surface treating article of claim 1 with the surface while causing relative movement between the surface and the article, thereby producing a high gloss surface.

15. A method of increasing the gloss of hard surfaces the method comprising contacting a nonwoven surface treating article of claim 13 with the surface while causing relative movement between the surface and the article, thereby producing a high gloss surface.

16. A flexible and resilient, fibrous surface treating article comprising an open, lofty, nonwoven fibrous web formed of entangled fibers bonded together at points where they contact one another by a binder, the binder comprising 1) a copolymer of a styrenic monomer and a diene monomer, 2) a polyol, 3) an optional melamine crosslinking agent, and 4) an optional reaction product of a urea derivative and formaldehyde.

17. A method of increasing the gloss of hard surfaces the method comprising contacting a nonwoven surface treating article of claim 16 with the surface while causing relative movement between the surface and the article, thereby producing a high gloss surface.

* * * * *